US006046759A

United States Patent [19]

Kim

[11] Patent Number: 6,046,759

[45] Date of Patent: Apr. 4, 2000

[54] LASER SCANNER TILT ADJUSTING APPARATUS FOR PRINTER

[75] Inventor: Ho-dong Kim, Yongin, Rep. of Korea

[73] Assignee: Samsung Electronics Co., Ltd., Kyungki-do, Rep. of Korea

[21] Appl. No.: 09/097,825

[22] Filed: Jun. 16, 1998

[30] Foreign Application Priority Data

Mar. 20, 1998 [KR] Rep. of Korea ..... 98-9707

[51] Int. Cl.[7] ..... B41J 7/02

[52] U.S. Cl. ..... 347/263; 347/138; 347/245; 347/257

[58] Field of Search ..... 347/138, 245, 347/257, 263; 399/110, 111; 384/50, 404, 407; 83/123; 248/188.2

[56] References Cited

U.S. PATENT DOCUMENTS 4,846,589 7/1989 Chikuma et al. ..... 384/50

4,862,779 9/1989 Nishimura et al. ..... 83/123

*Primary Examiner*—N. Le

*Assistant Examiner*—Hai C. Pham

*Attorney, Agent, or Firm*—Sughrue, Mion, Zinn Macpeak & Seas, PLLC

[57] ABSTRACT

A laser scanner tilt adjusting apparatus for a printer includes a guide rail formed at the internal surface of a frame on which a laser scanner is mounted, for forming an admittance path of the laser scanner, a plurality of guide rollers installed at either side of the laser scanner so as to slide along the guide rail, a plurality of elevating blocks elevatably installed on the guide rail, for supporting the bottom surfaces of the guide rollers when the laser scanner is completely inserted into the frame, and an elevating mechanism for raising and lowering the plurality of elevating blocks to adjust the tilt of the laser scanner.

6 Claims, 3 Drawing Sheets

LASER SCANNER TILT ADJUSTING APPARATUS FOR PRINTER

BACKGROUND OF THE INVENTION

1. Field of the Invention

The present invention relates to an apparatus for adjusting the tilt of a laser scanner for a printer.

2. Description of the Related Art

As shown in FIG. 1, a printer such as a color laser printer includes a laser scanner 10 for scanning laser beams onto an imaging surface 2*a* of a photoreceptor belt 2 to form a latent electrostatic image. The latent electrostatic image formed by the laser scanner 10 is developed by being supplied with a developer liquid having a predetermined color from a development unit 20 and the developed image is printed on a sheet of print paper 1 by a transfer unit 30. The quality of the image printed on the paper 1 depends upon the quality of the latent electrostatic image formed on the photoreceptor belt 2 by the laser scanner 10. For example, in order to obtain a clean image, the laser scanner 10 must be precisely maintained parallel to the photoreceptor belt 2, which allows the laser scanner 10 to scan the light parallel to and onto the imaging surface 2*a* thereof.

However, conventionally, since the laser scanner 10 is fixed on a frame (not shown) forming a printer body, the parallelism of the laser scanner 10 with respect to the photoreceptor belt 2 cannot be adjusted once assembly is completed. Thus, there is a necessity for an apparatus which can adjust the parallelism of the laser scanner 10 with respect to the photoreceptor belt 2 by adjusting the tilt of the laser scanner 10 even after the laser scanner 10 is mounted on the frame.

SUMMARY OF THE INVENTION

To solve the above problem, it is an objective of the present invention to provide a laser scanner tilt adjusting apparatus for a printer, which can adjust the tilt of a laser scanner after it is mounted on a frame of the printer.

Accordingly, to achieve the above objective, there is provided a laser scanner tilt adjusting apparatus for a printer including a guide rail formed at the internal surface of a frame on which a laser scanner is mounted, for forming an admittance path of the laser scanner, a plurality of guide rollers installed at either side of the laser scanner so as to slide along the guide rail, a plurality of elevating blocks elevatably installed on the guide rail, for supporting the bottom surfaces of the guide rollers when the laser scanner is completely admitted into the frame, and elevating means for raising and lowering the plurality of elevating blocks to adjust the tilt of the laser scanner.

Here, the elevating means includes a cam contacting the bottom surface of the elevating block, and a rotary knob coupled to the cam for rotating the same to raise and lower the elevating block.

Also, a groove is formed on the top surface of at least one of the plurality of elevating blocks so that at least one of the plurality of guide rollers are placed thereon.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 1:
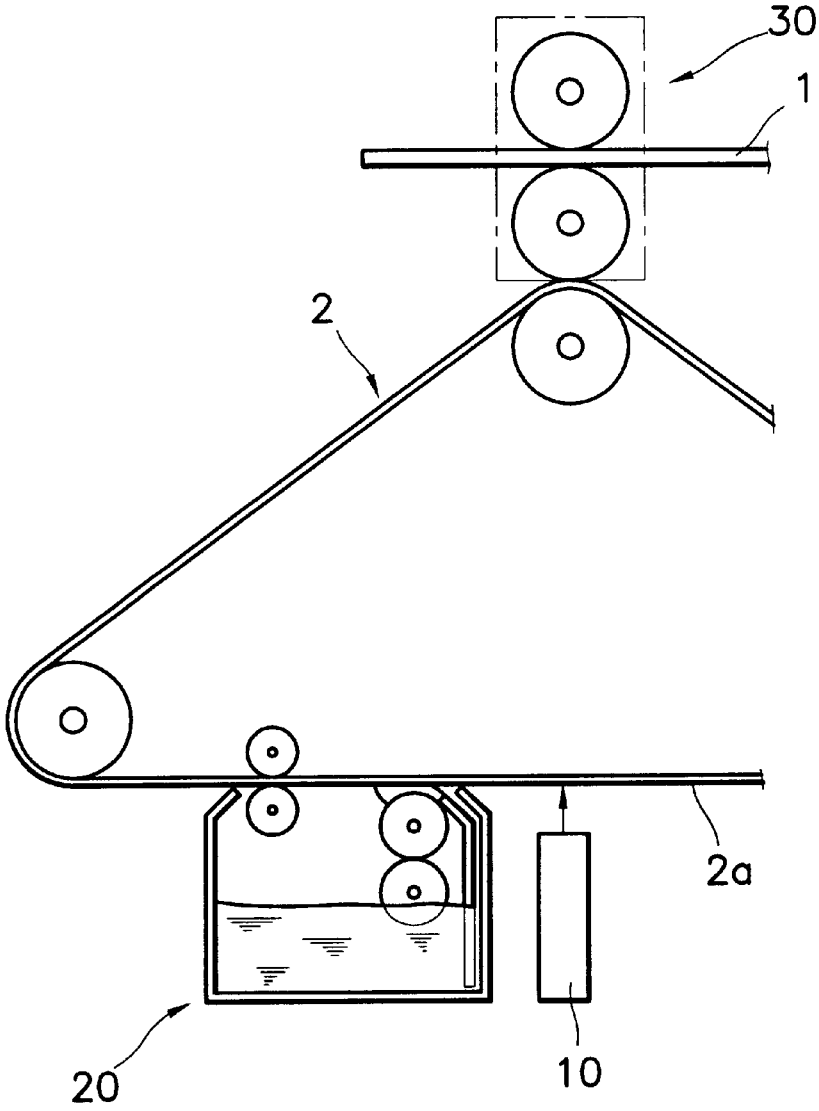
FIG. 1 (PRIOR ART)
FIG. 1 is a schematic diagram illustrating the internal structure of a general printer having a laser scanner.
Figure 2:
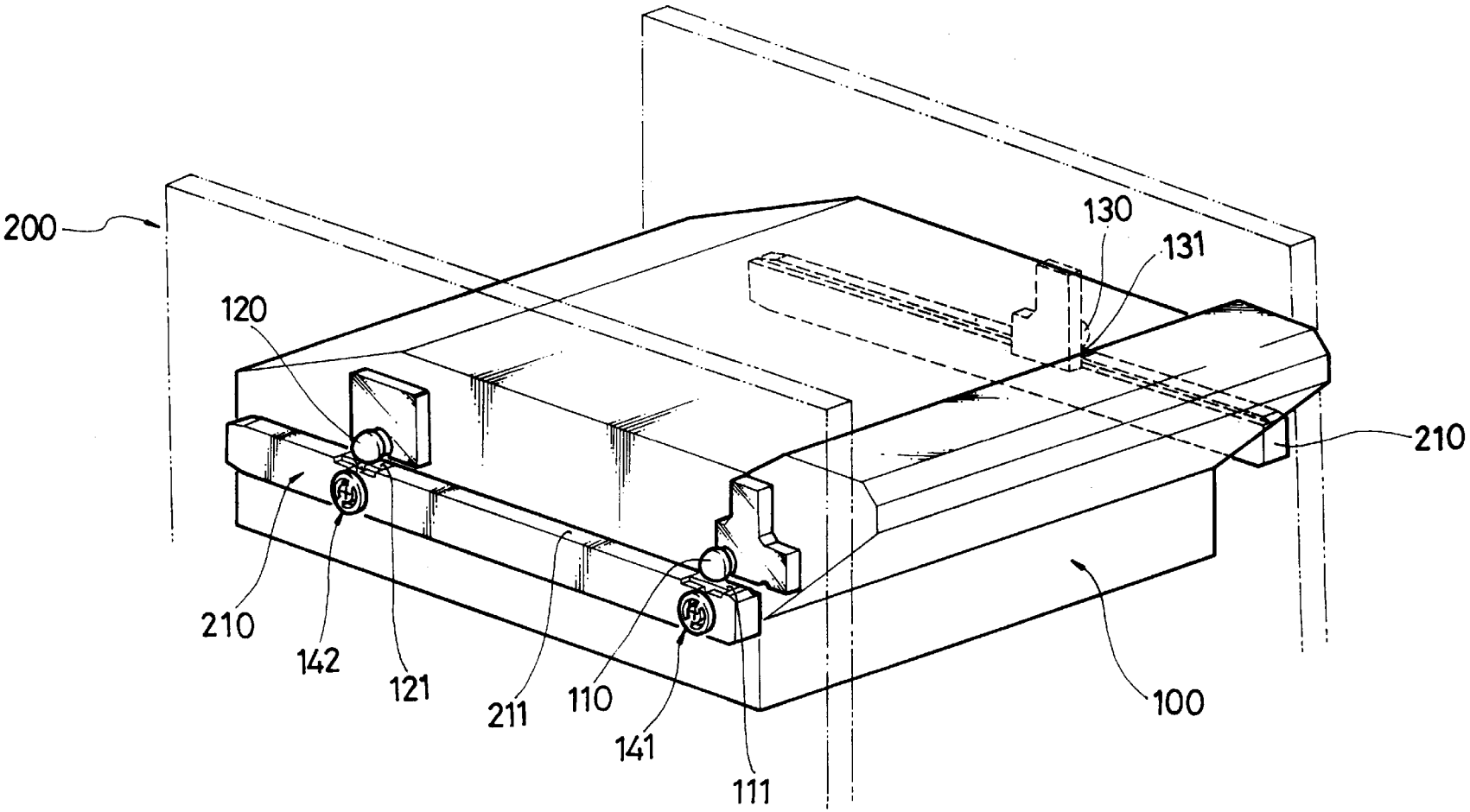
FIG. 2 is a schematic perspective view illustrating a laser scanner tilt adjusting apparatus according to the present invention.
Figure 3:
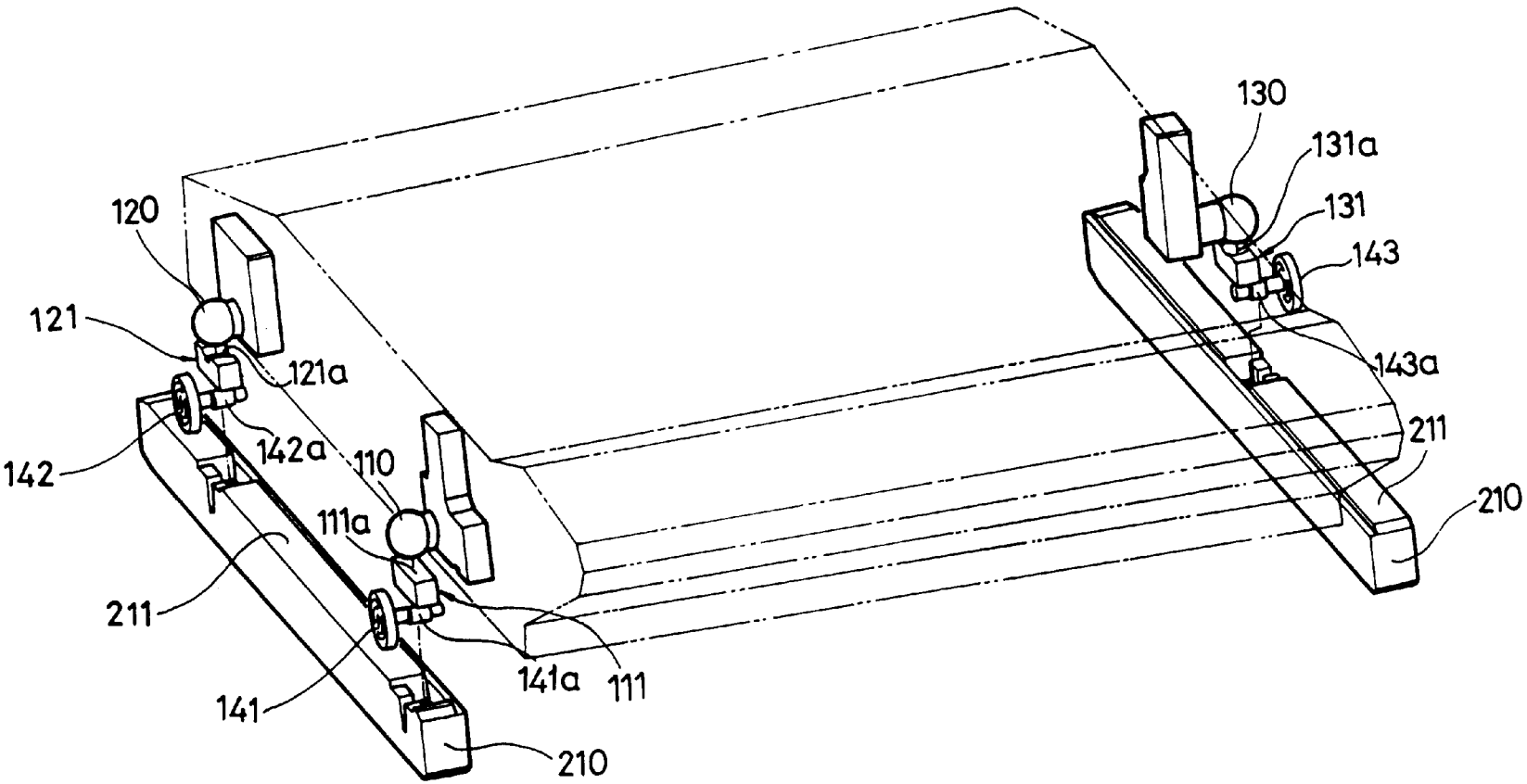
FIG. 3 is a partially exploded perspective view illustrating essential parts of the laser scanner tilt adjusting apparatus shown in FIG. 2.

Referring to FIGS. 2 and 3, a guide rail 210 for admitting a laser scanner 100 into a frame 200 is provided at the internal surface of the frame 200 forming a printer body, and first, second and third guide rollers 110, 120 and 130 sliding on a sliding plane 211 of the guide rail 210 are installed at either side of the laser scanner 100.

The first, second and third guide rollers 110, 120 and 130 are placed on the sliding plane 211 of the guide rail 210 and the laser scanner 100 is inserted into the frame 200 to be mounted thereon. Here, the third guide roller 130 is installed at the side other than the side at which the first and second guide rollers 110 and 120 are formed, to be positioned at a place corresponding to the middle of the first and second guide rollers 110 and 120.

Also, first, second and third elevating blocks 111, 121 and 131 for supporting the first, second and third guide rollers 110, 120 and 130, respectively, when the laser scanner 100 is completed admitted to the frame 200, are elevatably installed in the guide rail 210.

First, second and third eccentric cams 141*a*, 142*a* and 143*a* contacting the bottom surfaces of the first, second and third elevating blocks 111, 121 and 131 are coupled to first, second and third rotary knobs 141, 142 and 143 installed under the first, second and third elevating blocks 111, 121 and 131.

Thus, when the first, second and third rotary knobs 141, 142 and 143 are rotated, the first, second and third eccentric cams 141*a*, 142*a* and 143*a* rotate accordingly to raise the first, second and third elevating blocks 111, 121 and 131. Accordingly, the first, second and third guide rollers 110, 120 and 130 supported to the first, second and third elevating blocks 111, 121 and 131 are raised or lowered.

Also, grooves 121*a* and 131*a* are formed on the second and third elevating blocks 121 and 131 on which the second and third guide rollers 120 and 130 rest. Preferably, the groove 121*a* is V-shaped and the groove 131*a* is hemispherical. After the laser scanner 100 is completely mounted, the second and third guide rollers 120 and 130 rest on the grooves 121*a* and 131*a*, respectively, so that the laser scanner 100 can be prevented from deviating to the outside of the frame 200. The V-shaped groove 121*a* is preferably tilted with respect to the hemispherical groove 131*a*, which is for facilitating adjustment of the tilt of the laser scanner 100 since the second guide roller 120 is raised and lowered while rotating around the hemispherical groove 131*a*.

The top surface lila of the first elevating block 111 is planar. Thus, when the tilt of the laser scanner 100 is adjusted, the first guide roller 110 moves slightly on the top surface 111*a* back and forth, and left and right.

When the laser scanner 100 is mounted on the frame 200, the first, second and third guide rollers 110, 120 and 130 rest on the guide rail 210 and then the laser scanner 100 is inserted into the frame 200. If the laser scanner 100 is completely mounted within the frame 200, the first, second and third guide rollers 110, 120 and 130 are positioned on the first, second and third elevating blocks 111, 121 and 131, respectively. At this time, the second and third guide rollers 120 and 130 rest on the grooves 121*a* and 131*a*, respectively.

In such a state, the tilt of the laser scanner 100 is adjusted by rotating at least one of the rotary knobs 141, 142 and 143. The rotary knobs 141, 142 and 143 can be rotated manually or by using a tool such as a screwdriver.

For example, if the third rotary knob 143 is rotated, the third elevating block 131 is raised and lowered while the eccentric cam 143*a* of the rotary knob 143 is rotated. Accordingly, the tilt of the laser scanner 100 can be adjusted appropriately.

As described above, according to the present invention, a laser scanner tilt adjusting apparatus can adjust its tilt even after a laser scanner is mounted on a frame. Thus, the tilt error of the laser scanner generated during an assembling process can be simply corrected retroactively (post-assembly).

Although a laser scanner tilt adjusting apparatus having three guide rollers and three elevating blocks have been described through an illustrative embodiment of the invention, the present invention is not limited thereto and is applicable to one having more than three guide rollers and more than three elevating blocks.

It is conceivable that numerous modifications may be made to the laser scanner tilt adjusting apparatus for a printer of the present invention without departing from the spirit and scope of the invention as defined in the following claims.

What is claimed is:

1. A laser scanner tilt adjusting apparatus for a printer comprising:

a guide rail formed at an internal surface of a frame on which a laser scanner is mounted, for forming an admittance path of the laser scanner;

a plurality of guide rollers installed at either side of the laser scanner so as to slide along only a top surface of the guide rail;

a plurality of elevating blocks elevatably installed on the guide rail, for supporting bottom surfaces of the guide rollers when the laser scanner is completely admitted into the frame; and elevating means for raising and lowering the plurality of elevating blocks to adjust a tilt of the laser scanner.

2. The laser scanner tilt adjusting apparatus according to claim 1, wherein the elevating means comprises:

a cam contacting a bottom surface of each corresponding one of the elevating blocks; and a rotary knob coupled to the cam for rotating the same to raise and lower each corresponding one of the elevating blocks.

3. The laser scanner tilt adjusting apparatus according to claim 1, wherein a groove is formed on a top surface of at least one of the plurality of elevating blocks so that at least one of the plurality of guide rollers is placed thereon.

4. The laser scanner tilt adjusting apparatus according to claim 1, wherein the plurality of guide rollers include first and second guide rollers installed at one side of the laser scanner, and a third guide roller installed at the other side, and the elevating blocks include first, second and third elevating blocks corresponding to the first, second and third guide rollers.

5. The laser scanner tilt adjusting apparatus according to claim 4, wherein the third guide roller is formed at a place at the other side of the laser scanner corresponding to a middle of the first and second guide rollers, a V-shaped groove is formed on the top surface of at least one of the first and second elevating blocks, and a hemispherical groove is formed on the top surface of the third elevating block.

6. A laser scanner tilt adjusting apparatus for a printer comprising:

a guide rail formed at an internal surface of a frame on which a laser scanner is mounted, for forming an admittance path of the laser scanner;

a plurality of guide rollers installed at either side of the laser scanner so as to slide along the guide rail;

a plurality of elevating blocks each having a groove in a top surface of each of said elevating blocks, each of said elevating blocks being elevatably installed on the guide rail and supporting bottom surfaces of each of the guide rollers in each respective groove when the laser scanner is completely admitted into the frame;

a plurality of cams contacting each bottom surface of each corresponding one of said elevating blocks; and a plurality of rotary knobs coupled to said respective cams, said knobs which rotate to raise and lower each corresponding one of said elevating blocks to adjust a tilt of the laser scanner.

* * * * *